US006491364B2

(12) United States Patent
Pietrzyk (deceased) et al.

(10) Patent No.: US 6,491,364 B2
(45) Date of Patent: Dec. 10, 2002

(54) INKJET PRINTING WITH AIR MOVEMENT SYSTEM TO IMPROVE DOT SHAPE

(75) Inventors: Joe R. Pietrzyk (deceased), late of San Diego, by Susan L. Pietrazyk, legal representative; Thomas Michael Sabo, San Diego, both of CA (US); John Michael Kniffin, Wilsonville, OR (US); Dustin Wesley Blair, San Diego, CA (US); Grant Allen Webster, Valley Center, CA (US); Stephen William Bauer, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/844,010

(22) Filed: Apr. 27, 2001

(65) Prior Publication Data

US 2002/0158937 A1 Oct. 31, 2002

(51) Int. Cl.[7] ..... B41J 2/01
(52) U.S. Cl. ..... 347/21
(58) Field of Search ..... 347/21, 34, 37, 347/74, 78, 73

(56) References Cited

U.S. PATENT DOCUMENTS

| | | | | |
|---|---|---|---|---|
| 3,983,801 A | | 10/1976 | Watanabe et al. | 101/1 |
| 4,077,040 A | | 2/1978 | Hendriks | 346/75 |
| 4,369,450 A | | 1/1983 | Iwagami et al. | 346/75 |
| 4,411,706 A | | 10/1983 | Wallace et al. | 134/37 |
| 4,520,366 A | | 5/1985 | Cragin, Jr. | 347/74 |
| 4,591,869 A | | 5/1986 | Katerberg et al. | 347/21 |
| 5,625,398 A | | 4/1997 | Milkovits et al. | 347/104 |
| 5,774,141 A | | 6/1998 | Cooper et al. | 347/34 |
| 5,798,774 A | | 8/1998 | Okada et al. | 347/21 |
| 5,877,788 A | | 3/1999 | Haan et al. | 347/28 |
| 6,203,152 B1 | | 3/2001 | Boleda et al. | 347/102 |
| 6,220,693 B1 | * | 4/2001 | Bode et al. | 347/34 |
| 6,270,019 B1 | | 8/2001 | Reighard | 239/1 |

FOREIGN PATENT DOCUMENTS

| | | |
|---|---|---|
| JP | 57093164 | 6/1982 |
| JP | 58104758 | 6/1983 |
| JP | 11198413 | 7/1999 |

* cited by examiner

*Primary Examiner*—Anh T. N. Vo

(57) ABSTRACT

An inkjet printer for printing on a print medium includes a printhead having an ink orifice formed therein through which an ink drop is ejected into a print zone between the printhead and the print medium during printing, and an air movement system which directs a stream of gas through the print zone as the ink drop is ejected during printing. When ejected, the ink drop forms a head and a tail. As such, the stream of gas converges the tail of the ink drop and the head of the ink drop during printing so as to improve the shape of a dot formed by the ink drop on the print medium.

54 Claims, 4 Drawing Sheets

INKJET PRINTING WITH AIR MOVEMENT SYSTEM TO IMPROVE DOT SHAPE

THE FIELD OF THE INVENTION

The present invention relates generally to printing with inkjet printers, and more particularly to an inkjet printer having an air movement system which converges a tail or satellite and a head of an ink drop as formed by the ink drop during printing.

BACKGROUND OF THE INVENTION

As illustrated in FIG. 1, a portion of a conventional inkjet printer 90 includes a printer carriage 91 and a print cartridge 92 installed in the printer carriage. The print cartridge includes a printhead 93 which ejects or fires ink drops 94 through a plurality of orifices or nozzles 95 and toward a print medium 96, such as a sheet of paper, so as to print a dot of ink on the print medium. Typically, the orifices are arranged in one or more columns or arrays such that properly sequenced ejection of ink from the orifices causes characters or other images to be printed upon the print medium as the print cartridge and the print medium are moved relative to each other.

During ejection, one or more of the ink drops of the conventional inkjet printer form a primary drop or head 97 and a secondary drop or tail 98 which trails from or follows the head of the ink drop. Often, the tail of the ink drop separates from the head of the ink drop and forms a satellite 99 of the ink drop. The tail or satellite of the ink drop is often smaller than the head of the ink drop and typically has a different air resistance, speed, and trajectory than the head of the ink drop. For example, as the printer carriage and print cartridge move relative to print medium in the direction indicated in FIG. 1, a trajectory of the tail or satellite of the ink drop diverges from a trajectory of the head of the ink drop as the ink drop travels between the printhead and the print medium. Thus, the tail or satellite of the ink drop lands on the print medium away from where the head of the ink drop lands. As such, the tail or satellite of the ink drop forms an extraneous dot on the print medium around the edges and/or in the background of a character printed on the print medium. This extraneous dot, however, results in an image quality defect, referred to as spray, which causes the character to appear fuzzy. Controlling spray, therefore, is important since the eye is very sensitive to this type of image quality defect.

Unfortunately, increasing a spacing between the print cartridge and the print medium (i.e., pen-to-paper spacing) to accommodate, for example, a greater range of print medium thickness increases the possibility of spray since the ink drop has a greater distance to travel and, therefore, a greater distance within which to deviate from the head of the ink drop. In addition, moving the printer carriage and printhead at greater velocities to achieve, for example, faster printing speeds and, therefore, higher throughput also increases the possibility of spray.

Attempts to minimize or eliminate spray caused by the tail or satellite of the ink drop have utilized, for example, slower printer carriage speeds and reduced pen-to-paper spacing as well as lower drop velocities, clear-mode operations, and non-circular orifices. These attempts, however, are leading in a direction contrary to the desired direction of inkjet printer advancement, such as faster printing speeds for higher throughput and increased pen-to-paper spacing for accommodating a greater range of print medium thickness.

Reducing carriage speed, for example, reduces throughput of the inkjet printer and reducing pen-to-paper spacing limits the range of print medium thickness the inkjet printer can handle. In addition, operating at lower drop velocities generally degrades a reliability and trajectory of the ink drops since the ink drops have a lower momentum and, therefore, are more easily disrupted. In addition, operating in clear modes of operations, where the entire contents of the firing chamber and nozzle are ejected, results in slower refill times and, therefore, reduced frequency response as well as a greater tendency to form air bubbles in the firing chamber.

Accordingly, a need exists for an inkjet printer which substantially eliminates image quality defects, such as spray, caused by tails or satellites of ink drops formed during printing, without compromising printing speed, printing reliability, and/or print medium accommodation.

SUMMARY OF THE INVENTION

One aspect of the present invention provides an inkjet printer for printing on a print medium. The inkjet printer includes a printhead having an ink orifice formed therein through which an ink drop is ejected into a print zone between the printhead and the print medium during printing, and an air movement system which directs a stream of gas through the print zone as the ink drop is ejected during printing. The ink drop includes a head and a tail. As such, the stream of gas converges the tail of the ink drop and the head of the ink drop during printing.

In one embodiment, the head of the ink drop has a first trajectory rate during printing and the tail of the ink drop has a second trajectory rate less than the first trajectory rate during printing. As such, the stream of gas impedes the first trajectory rate of the head of the ink drop during printing.

In one embodiment, the tail of the ink drop forms a satellite of the ink drop. As such, the stream of gas converges the satellite of the ink drop with the head of the ink drop during printing.

In one embodiment, the head of the ink drop has a head trajectory during printing and the satellite of the ink drop has a satellite trajectory during printing. As such, the air movement system directs the stream of gas through the head trajectory and the satellite trajectory during printing. In one embodiment, the stream of gas disrupts the satellite trajectory during printing, but does not disrupt the head trajectory during printing.

In one embodiment, the stream of gas converges the satellite trajectory with the head trajectory during printing. In one embodiment, the satellite trajectory originates at a starting point of the head trajectory and terminates at approximately an ending point of the head trajectory. The satellite trajectory, however, is longer than the head trajectory.

In one embodiment, the head of the ink drop forms a first dot on the print medium during printing and the satellite of the ink drop forms a second dot on the print medium during printing. As such, the second dot is positioned within the first dot on the print medium. In one embodiment, the first dot has a first diameter and the second dot has a second diameter less than the first diameter.

In one embodiment, the printhead moves in a first direction relative to the print medium during printing. As such, the air movement system directs the stream of gas in a second direction opposite the first direction.

In one embodiment, the print medium moves in a first direction relative to the printhead during printing. As such, the air movement system directs the stream of gas in the first direction.

In one embodiment, the air movement system directs the stream of gas in a direction toward an already-imprinted region of the print medium.

In one embodiment, the stream of gas is an air stream. In one embodiment, the air movement system includes an airflow source which generates the air stream. In one embodiment, movement of the printhead within the printer generates the air stream.

In one embodiment, the air movement system includes an air ram formed adjacent a leading end of the printhead. As such, the air ram directs the air stream from the leading end of the printhead to the print zone during printing.

In one embodiment, the ink orifice is formed in a front face of the printhead. As such, the air movement system directs the stream of gas substantially parallel to the front face of the printhead.

In one embodiment, a speed of the stream of gas through the print zone is in a range of approximately 3 meters/second to approximately 10 meters/second. In one embodiment, the speed of the stream of gas through the print zone is in a range of approximately 3 meters/second to approximately 5 meters/second.

Another aspect of the present invention provides a method of printing on a print medium with an inkjet printer including a printhead having an ink orifice formed therein. The method includes ejecting an ink drop through the ink orifice toward the print medium into a print zone between the printhead and the print medium during printing, and directing a stream of gas through the print zone as the ink drop is ejected during printing. The ink drop forms a head and a tail such that the stream of gas converges the tail of the ink drop and the head of the ink drop during printing.

The present invention provides a system which converges a tail and a head of an ink drop as formed by the ink drop during printing. In addition, the system converges a satellite, as formed by the tail of the ink drop, with the head of the ink drop during printing. As such, extraneous printed features around the edges and/or in the background of a character, caused by the tail or satellite of the ink drop during printing, are avoided without compromising printing speed, printing reliability, and/or accommodation of various thickness of print medium.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "left," "right," "leading," "trailing," etc., is used with reference to the orientation of the FIG.(s) being described. The inkjet printer and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
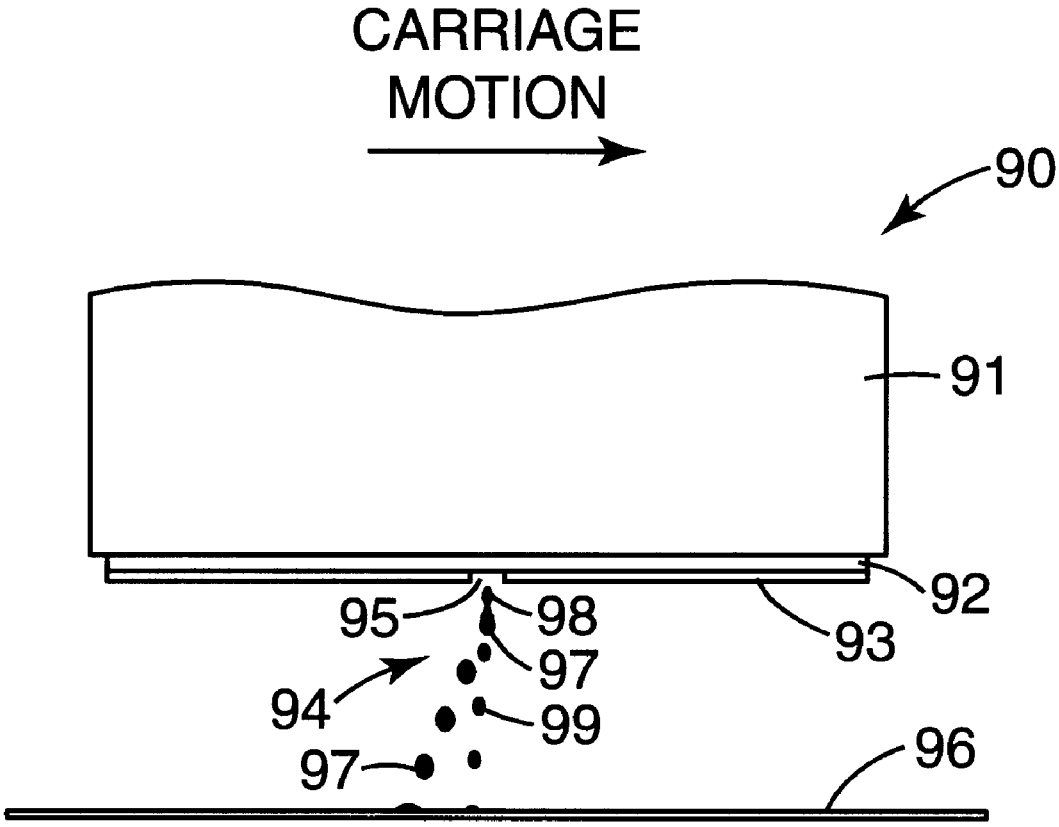
Fig. 1 PRIOR ART
FIG. 1 is a side schematic view of a portion of a prior art inkjet printer.
Figure 2:
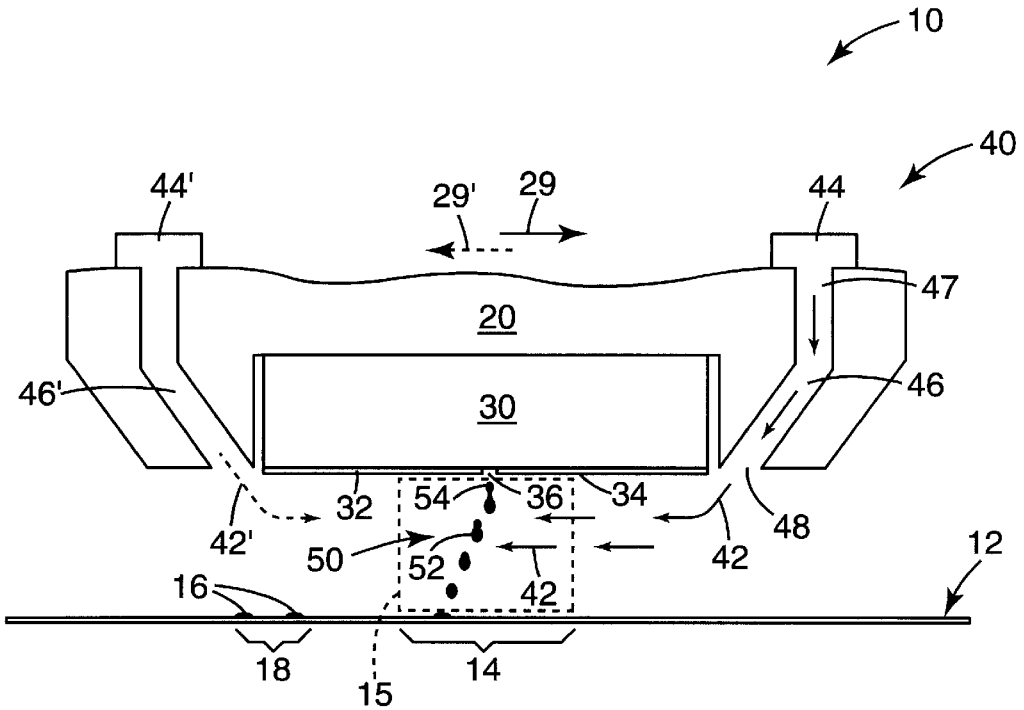
FIG. 2 is a side schematic view of one embodiment of a portion of an inkjet printer including one embodiment of an air movement system according to the present invention.

FIG. 2 illustrates one embodiment of a portion of an inkjet printer 10 for printing on a print medium 12. Inkjet printer 10 includes a printer carriage 20, a print cartridge 30, and an air movement system 40. Print medium 12 includes a print region 14 within which print 16 in the form of characters and graphics is created as relative movement between print cartridge 30 and print medium 12 occurs during printing. Print medium 12 is any type of suitable material, such as paper, cardstock, transparencies, Mylar, and the like.

In one embodiment, during printing, print medium 12 is held stationary as printer carriage 20 and print cartridge 30 move in a printing direction, as indicated by arrow 29, to traverse print medium 12 and create print 16. Upon completing a row of print 16, print medium 12 is advanced in a direction substantially perpendicular to the printing direction indicated by arrow 29 (i.e., in and out of the plane of the paper). Thereafter, print medium 12 is held stationary as printer carriage 20 and print cartridge 30 move in a printing direction, as indicated by arrow 29', opposite the printing direction indicated by arrow 29, to traverse print medium 12 and create another row of print 16.

Printer carriage 20 is slidably supported within a housing (not shown) of inkjet printer 10 for travel back and forth across print medium 12, and print cartridge 30 is installed in printer carriage 20 for movement with printer carriage 20 during printing. Print cartridge 30 includes a printhead 32 having a front face 34 in which a plurality of ink orifices or nozzles 36 are formed in a manner well known to those skilled in the art. For clarity of the invention, only one ink orifice 36 is illustrated. It is understood, however, that printhead 32 may include one or more columns or other arrays of ink orifices 36.

Example embodiments of printhead 32 include a thermal printhead, a piezoelectric printhead, a flex-tensional printhead, or any other type of inkjet ejection device known in the art. If printhead 32 is, for example, a thermal printhead, printhead 32 typically includes a substrate layer (not shown) having a plurality of resistors (not shown) which are operatively associated with ink orifices 36. Upon energization of the resistors, in response to command signals delivered by a controller (not shown) to print cartridge 30, drops of ink 50 are ejected through ink orifices 36 toward print medium 12.

Ink drops 50 are ejected through ink orifices 36 and from printhead 32 into a print zone 15 with an intended ink drop trajectory. Print zone 15 is defined as being between printhead 32 and print medium 12, and encompasses ink drops 50. As such, print zone 15, as well as print region 14 of print medium 12, move with print cartridge 30 during printing. The intended ink drop trajectory is defined by a plurality of ink drops 50 ejected toward print medium 12 to form a trail of ink drops 50 extending between printhead 32 and print medium 12. It is understood that the intended ink drop trajectory of ink drops 50, as illustrated in FIG. 2, for example, has been exaggerated for clarity of the invention.

During printing, ink drops 50 are ejected from printhead 32 toward print region 14 of print medium 12 to create print 16. As printer carriage 20 and print cartridge 30 move in the printing direction indicated by arrow 29, for example, print 16 creates an already-imprinted region 18 on print medium 12. Thus, already-imprinted region 18 is created to the left of printer carriage 20.

In one embodiment, one or more ink drops 50 include a head 52 and a tail 54. Tail 54 is generally smaller than and extends from head 52 when ink drop 50 is ejected. Since tail 54 is smaller than head 52, tail 54 also has less air resistance than head 52. Tail 54, therefore, has a trajectory rate less than that of head 52. As such, tail 54 generally follows behind head 52.

Air movement system 40 directs a stream of gas, for example, an air stream 42, through print zone 15 as ink drops 50 are ejected from printhead 32 during printing. Since head 52 of ink drop 50 is generally larger than tail 54 of ink drop 50, head 52 has more air resistance than tail 54. Head 52, therefore, is more greatly influenced by air stream 42 than is tail 54. As such, air movement system 40 directs air stream 42 through the intended ink drop trajectory of ink drops 50 during printing so as to influence head 52 and converge tail 54 of ink drop 50 and head 52 of ink drop 50.

In one embodiment, air movement system 40 converges tail 54 of ink drop 50 and head 52 of ink drop 50 by slowing or impeding the trajectory rate of head 52 during printing. As such, head 54 and tail 52 converge and fall together between printhead 32 and print medium 12, as illustrated in FIG. 2. Thus, air movement system 40 and, more specifically, air stream 42 converges tail 54 of ink drop 50 and head 52 of ink drop 50 during printing. While the following description only refers to using air, it is understood that use of other gases, or combinations of gases, is within the scope of the present invention.

In one embodiment, air stream 42 is directed in a direction toward already-imprinted region 18 of print medium 12. As illustrated in FIG. 2, for example, printer carriage 20 and print cartridge 30 move in the printing direction indicated by arrow 29, from left to right, relative to print medium 12. Thus, already-imprinted region 18 is created to the left of printer carriage 20 during printing. Air stream 42, therefore, is directed in a direction from right to left, toward already-imprinted region 18 or, conversely, opposite the printing direction indicated by arrow 29. Preferably, air stream 42 is directed through print zone 15 substantially parallel to front face 34 of printhead 32 and substantially parallel to print region 14 of print medium 12 toward which ink drops 50 are ejected.

FIG. 2 illustrates one embodiment of air movement system 40. Air movement system 40 includes an airflow source 44 which creates a pressurized source of air which, in turn, generates and forces air stream 42 through print zone 15. In one embodiment, air movement system 40 also includes an airflow channel 46 which directs air stream 42 through print zone 15. Airflow channel 46 includes, for example, an inlet flow path 47 and an outlet flow path 48. Inlet flow path 47 communicates with airflow source 44 which generates and forces air stream 42 through airflow channel 46.

In one embodiment, airflow source 44 includes an active or direct source which generates air stream 42 and communicates with inlet flow path 47 to force air stream 42 through airflow channel 46. As such, outlet flow path 48 directs air stream 42 through print zone 15. An example of airflow source 44 includes a fan or blower positioned with inkjet printer 10 and communicated with airflow channel 46.

Airflow source 44 and airflow channel 46 generate and direct air stream 42 through print zone 15 while printer carriage 20 and print cartridge 30 move in the direction indicated by arrow 29, from left to right, relative to print medium 12 during printing. Air movement system 40, therefore, also includes an airflow source 44' and an airflow channel 46' which generate and direct an air stream 42' through print zone 15 while printer carriage 20 and print cartridge 30 move in the direction indicated by arrow 29', from right to left, relative to print medium 12 during printing. Airflow source 44' and airflow channel 46' are similar to airflow source 44 and airflow channel 46, respectively, as described above. While airflow source 44' is illustrated as being separate from airflow source 44, it is within the scope of the present invention for airflow source 44' and airflow source 44 to be a single airflow source.

In one embodiment, as illustrated in FIG. 2, airflow channel 46 is formed in printer carriage 20 for travel with printer carriage 20 during printing. While airflow channel 46 is illustrated as being formed integrally with printer carriage 20, it is within the scope of the present invention for airflow channel 46 to be formed separately from printer carriage 20. As such, it is also within the scope of the present invention for airflow channel 46 to move with printer carriage 20 or be held stationary relative to printer carriage 20. While airflow source 44 is illustrated as being positioned adjacent inlet flow path 47 of airflow channel 46, it is within the scope of the present invention for airflow source 44 to be positioned remotely from and communicated with inlet flow path 47 of airflow channel 46.

Figure 3:
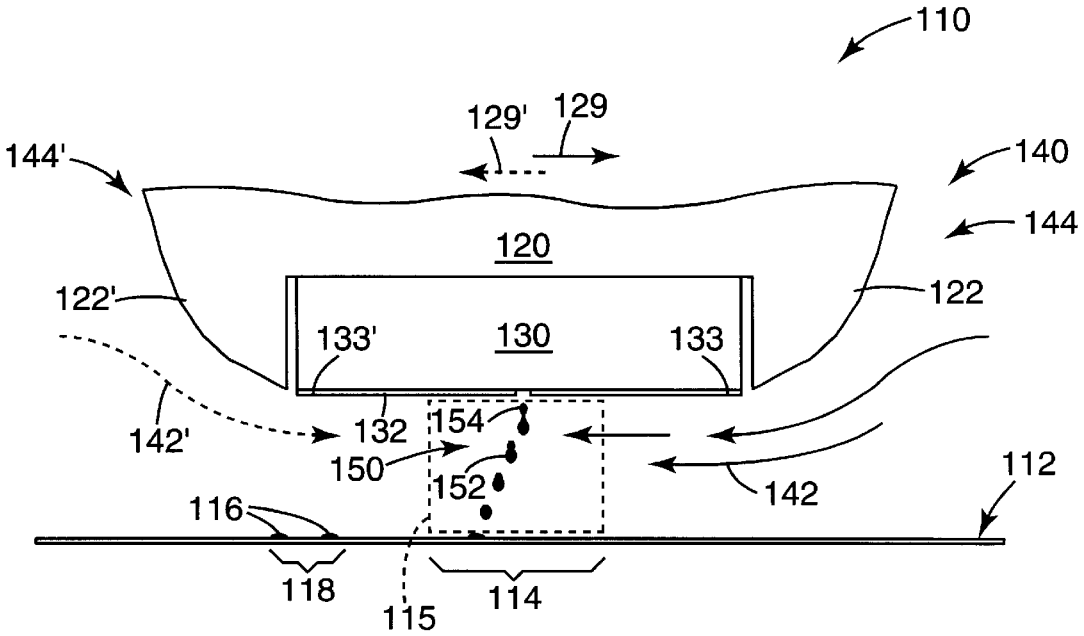
FIG. 3 is a side schematic view of another embodiment of the inkjet printer of FIG. 2 including another embodiment of an air movement system according to the present invention.

FIG. 3 illustrates another embodiment of a portion-of inkjet printer 10 including another embodiment of air movement system 40. Inkjet printer 110 includes a printer carriage 120, a print cartridge 130 including a printhead 132, and an air movement system 140. Print medium 112 includes a print region 114 within which print 116 in the form of characters and graphics is created as ink drops 150 are ejected into print zone 115 and relative movement between print cartridge 130 and print medium 112 occurs during printing. Similar to ink drops 50, ink drops 150 include a head 152 and a tail 154.

Air movement system 140 includes an airflow source 144 which generates and forces an air stream 142 through print zone 115. In one embodiment, air movement system 140 converges tail 154 of ink drop 150 and head 152 of ink drop 150 by slowing or impeding the trajectory rate of head 152 during printing. As such, head 154 and tail 152 converge and fall together between printhead 132 and print medium 112, as illustrated in FIG. 3. Thus, air movement system 140 and, more specifically, air stream 42 converges tail 54 of ink drop 50 and head 52 of ink drop 50 during printing in a manner similar to how air movement system 40 and, more specifically, air stream 42 converges tail 54 of ink drop 50 and head 52 of ink drop 50 during printing, as described above.

In one embodiment, airflow source 144 includes a passive or indirect source which generates air stream 142 and forces air stream 142 through print zone 115. An example of airflow source 144 includes inkjet printer 110 itself.

More specifically, air stream 142 is generate by movement of printer carriage 120 within inkjet printer 110. Printer carriage 120, for example, includes an air ram 122 formed adjacent to a side of print cartridge 130 and an end 133 of printhead 132. As such, motion of printer carriage 120 and air ram 122 generate and direct air stream 142 from end 133 of printhead 132 to print zone 115 during printing. Air ram 122, therefore, forms a portion of airflow source 144.

In one illustrative embodiment, air ram 122 has a portion adjacent to printhead 32 which is oriented at an angle to print medium 12 and/or to a plane of front face 34 of printhead 32 of approximately 30 degrees. In addition, air ram 122 has a cross-sectional area of approximately 2500 millimeters squared or more.

When printer carriage 120, including print cartridge 130 and printhead 132, moves in the direction indicated by arrow 129, end 133 of printhead 132 represents a leading end of printhead 132. As such, air ram 122 directs air stream 142 from the leading end of printhead 132 to print zone 115 while printer carriage 120 and print cartridge 130 move in the direction indicated by arrow 129, from left to right, relative to print medium 112 during printing. Air movement system 140, therefore, also includes an airflow source 144' which generates and forces an air stream 142' through print zone 115 while printer carriage 120 and print cartridge 130 move in the direction indicated by arrow 129', from right to left, relative to print medium 112 during printing. Thus, printer carriage 120 includes an air ram 122' formed adjacent to an opposite side of print cartridge 130 and an opposite end 133' of printhead 132.

When printer carriage 120, including print cartridge 130 and printhead 132, moves in the direction indicated by arrow 129', end 133' of printhead 132 represents a leading end of printhead 132. As air ram 122' is similar to air ram 122, motion of printer carriage 120 and air ram 122' generate and direct air stream 142' from the leading end of printhead 132 to print zone 115 while printer carriage 120 and print cartridge 130 move in the direction indicated by arrow 129', from right to left, relative to print medium 112 during printing. Air stream 142', therefore, converges tail 154 of ink drop 150 and head 152 of ink drop 150 when printing in the direction indicated by arrow 129'.

Figure 4:
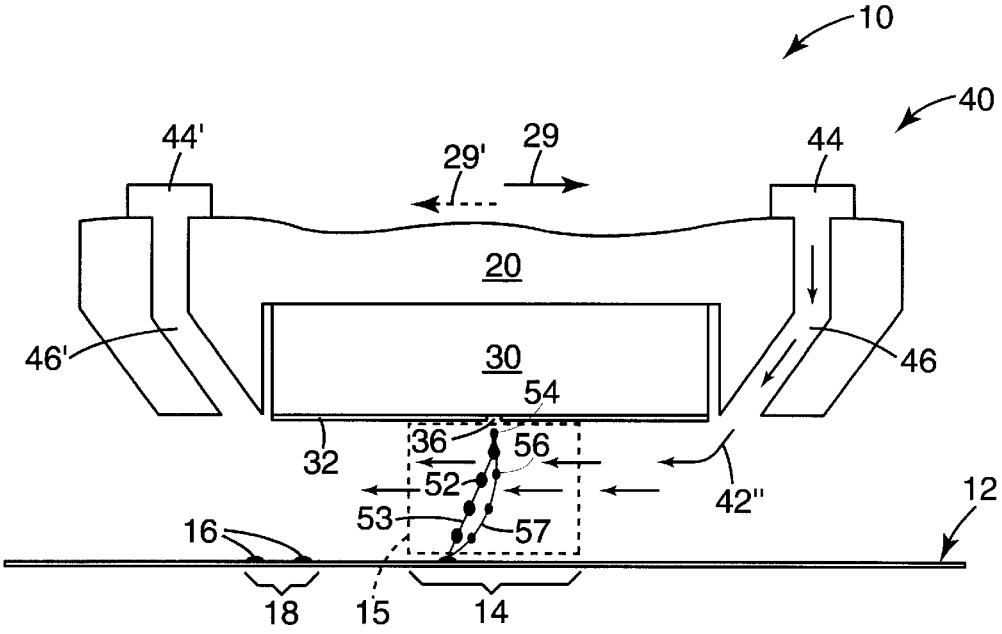
FIG. 4 is a side schematic view of the inkjet printer of FIG. 2 including another application of the air movement system according to the present invention.

In one embodiment, as illustrated in FIG. 4, tail 54 of ink drop 50 separates from head 52 and forms a satellite 56 of ink drop 50. As such, ink drop 50 includes head 52 and satellite 56, with satellite 56 representing a form of tail 54. Satellite 56 of ink drop 50 is smaller and has a volume less than that of head 52 of ink drop 50. Satellite 56 of ink drop 50, therefore, has a different air resistance, speed, and trajectory than that of head 52 of ink drop 50. It is to be understood that satellite 56 may include multiple satellites.

During printing, head 52 of ink drop 50 has a head trajectory 53 and satellite 56 of ink drop 50 has a satellite trajectory 57. Head trajectory 53 represents a path of head 52 during printing and satellite trajectory 57 represents a path of satellite 56 during printing. Since, at the time of ejection, tail 54 and, therefore, satellite 56 is a part of head 52, satellite trajectory 57 originates at a starting point of head trajectory 53. However, once tail 54 of ink drop 50 separates from head 52 and forms satellite 56 of ink drop 50, satellite trajectory 57 of satellite 56 diverges from head trajectory 53 of head 52 since satellite 56 is smaller than head 52 and has a different air resistance and speed than head 52.

FIG. 4, therefore, illustrates another application of air movement system 40. Air movement system 40 directs a stream of gas, for example, an air stream 42", through print zone 15 as ink drops 50 are ejected from printhead 32 during printing. More specifically, air movement system 40 directs air stream 42" through head trajectory 53 of head 52 and satellite trajectory 57 of satellite 56 during printing. As such, air movement system 40 may include, for example, an active or direct airflow source 44 and/or 44', as illustrated and described above with reference to FIG. 2, or a passive or indirect airflow source 144 and/or 144', as illustrated and described above with reference to FIG. 3. Since satellite 56 of ink drop 50 is smaller than head 52 of ink drop 50, satellite 56 is more greatly influenced by air stream 42" than is head 52. As such, air stream 42" of air movement system 40 disrupts satellite trajectory 57 of satellite 56 during printing. Preferably, air stream 42", however, does not disrupt head trajectory 53 of head 52 during printing. As such, air stream 42" converges satellite trajectory 57 with head trajectory 53 during printing, as illustrated in FIG. 4. Thus, satellite trajectory 57 originates at a starting point of head trajectory 53, as described above, and terminates at approximately an ending point of head trajectory 53. Satellite trajectory 57, however, is longer than head trajectory 53. Thus, air movement system 40 and, more specifically, air stream 42" converges satellite 56, as a form of tail 54, and head 52 during printing. It is understood that head trajectory 53 and satellite trajectory 57 of head 52 and satellite 53, respectively, as illustrated in FIG. 4, for example, have been exaggerated for clarity of the invention.

Figure 5:
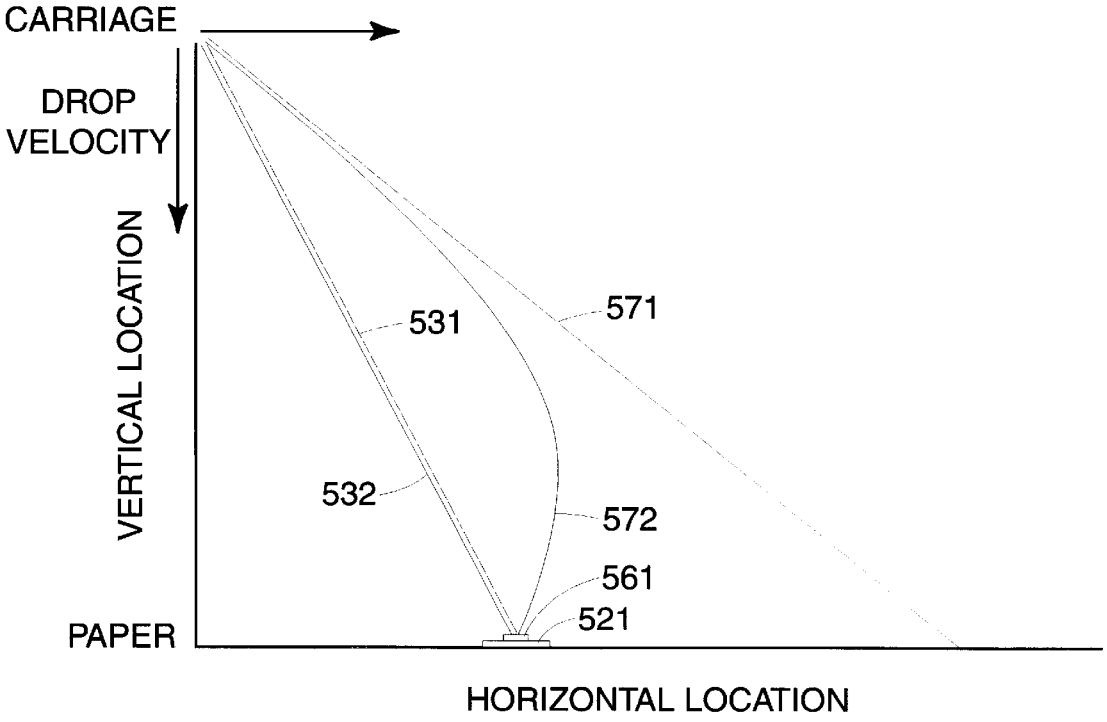
FIG. 5 is a graphical representation of a drop trajectory of an ink drop of an inkjet printer with and without an air movement system according to the present invention.

FIG. 5 illustrates one embodiment of a graphical representation of head trajectory 53 and satellite trajectory 57 of head 52 and satellite 56, respectively, of ink drop 50 during printing. Head trajectory 53 and satellite trajectory 57 are illustrated from the perspective of print medium 12. Without air stream 42", for example, satellite trajectory 57, as illustrated by line 571, diverges from head trajectory 53, as illustrated by line 531. As such, satellite 56 lands on print medium 12 away from where head 52 lands on print medium 12. Thus, satellite 56 results in an image quality defect, referred to as spray, by creating an extraneous dot on print medium 12.

With air stream 42", however, satellite trajectory 57, as illustrated by line 572, converges with head trajectory 53, as illustrated by line 532. As such, head 52 of ink drop 50 forms a first dot 521 on print medium 12 and satellite 56 of ink drop 50 forms a second dot 561 on print medium 12. Since satellite 56 is smaller than head 52, a diameter of second dot 561 formed by satellite 56 is less than a diameter of first dot 521 formed by head 52. In addition, since air stream 42" converges satellite trajectory 57 with head trajectory 53 during printing, second dot 561 formed by satellite 56 is positioned within first dot 521 formed by head 52. Thus, satellite trajectory 57 originates at a starting point of head trajectory 53 and terminates at approximately an ending point of head trajectory 53. A path of satellite trajectory 57, as disrupted by air stream 42" and illustrated by line 572, however, is longer than a path of head trajectory 53, as illustrated by line 532.

A speed of air stream 42", for example, is selected so as to converge satellite trajectory 57 with head trajectory 53 during printing. In one illustrative embodiment, the speed of air stream 42" through print zone 15 is in a range of approximately 3 meters/second to approximately 10 meters/second. In another illustrative embodiment, the speed of air stream 42" through print zone 15 is in a range of approximately 3 meters/second to approximately 5 meters/second. In addition, a relative speed between printer carriage 20 and print medium 12 is approximately 30 inches/second or 0.76 meters/second or higher, and a pen-to-paper spacing between print cartridge 30 and print medium 12 is approximately 2 meters or less. Furthermore, a drop diameter of head 52 and satellite 56 is approximately 21 micrometers or less and approximately 9 micrometers or less, respectively, and a drop velocity of head 52 and satellite 56 is approximately 12 meters/second or greater and approximately 5 meters/second or greater, respectively.

In one illustrative embodiment, a speed of air stream 42", for example, through print zone 15 is approximately 3.8 meters/second. In addition, a speed of printer carriage 20 relative to print medium 12 is approximately 1.52 meters/second and a pen-to-paper spacing between print cartridge 30 and print medium 12 is approximately 2 millimeters. Furthermore, a drop diameter of head 52 and satellite 56 is approximately 21 micrometers and approximately 18 micrometers, respectively, and a drop velocity of head 52 and satellite 56 is approximately 12 meters/second and approximately 6 meters/second, respectively. As such, head 52 and satellite 56 land and create a single dot on print medium 12 having a diameter of approximately 50 micrometers. Without air stream 42", however, head 52 and satellite 56 land and create two dots on print medium 12 with a separation of greater than approximately 400 micrometers between where satellite 56 lands on print medium 12 and where head 52 lands on print medium 12.

In another illustrative embodiment, a speed of air stream 42", for example, through print zone 15 is approximately 4.2 meters/second. In addition, a speed of printer carriage 20 relative to print medium 12 is approximately 0.76 meters/second and a pen-to-paper spacing between print cartridge 30 and print medium 12 is approximately 1 millimeter. Furthermore, a drop diameter of head 52 and satellite 56 is approximately 21 micrometers and approximately 18 micrometers, respectively, and a drop velocity of head 52 and satellite 56 is approximately 12 meters/second and approximately 6 meters/second, respectively. As such, head 52 and satellite 56 land and create a single dot on print medium 12 having a diameter of approximately 50 micrometers. Without air stream 42", however, head 52 and satellite 56 land and create two dots on print medium 12 with a separation or approximately 80 micrometers between where satellite 56 lands on print medium 12 and where head 52 lands on print medium 12.

Figure 6:
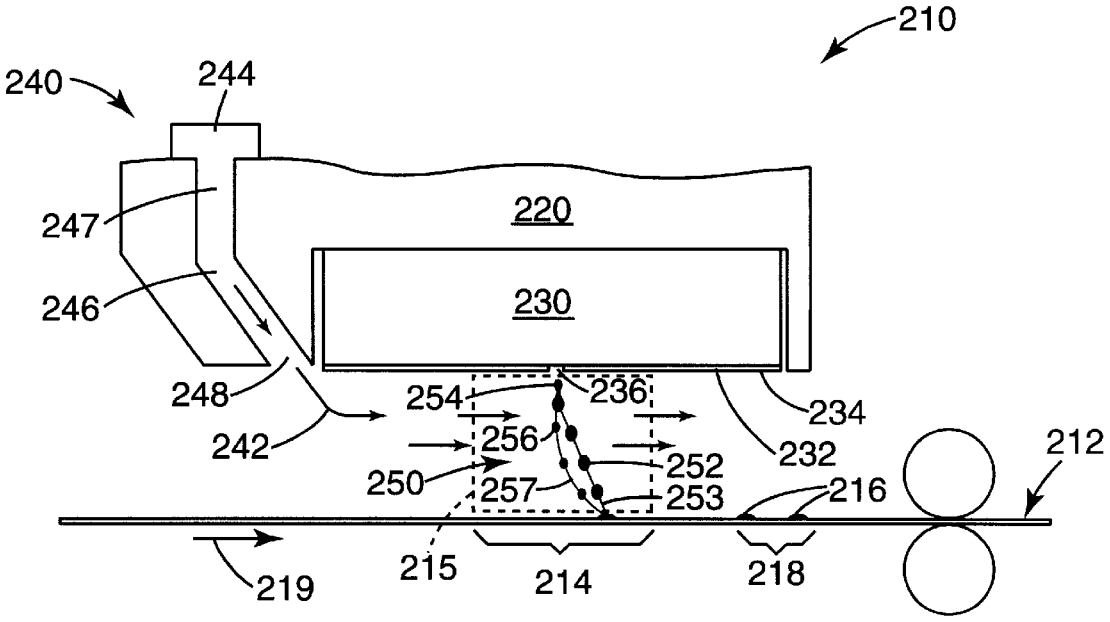
FIG. 6 is a side schematic view of another embodiment of a portion of an inkjet printer including one embodiment of an air movement system according to the present invention.

FIG. 6 illustrates another embodiment of a portion of an inkjet printer 210 for printing on a print medium 212. Inkjet printer 210 includes a printer carriage 220, a print cartridge 230, and an air movement system 240. Print medium 212 includes a print region 214 within which print 216 in the form of characters and graphics is created as relative movement between print cartridge 230 and print medium 212 occurs during printing. Inkjet printer 210 is similar to inkjet printer 10 with exception that, during printing, printer carriage 220 and print cartridge 230 are stationary and print medium 212 moves in a direction indicated by arrow 219, which is opposite to a printing direction, for relative movement between print cartridge 230 and print medium 212. It is, however, also within the scope of the present invention for print medium 212 to move in a direction opposite the direction indicated by arrow 219.

Printer carriage 220 is supported within a housing (not shown) of inkjet printer 210 and print cartridge 230 is installed in printer carriage 220. Print cartridge 230 includes a printhead 232 having a front face 234 in which a plurality of ink orifices or nozzles 236 are formed. Operation of printhead 232 is the same as that previously described in connection with printhead 32 and, therefore, is omitted here.

Ink drops 250 are ejected through ink orifices 236 and from printhead 232 into a print zone 215 with an intended ink drop trajectory. Print zone 215 is defined between printhead 232 and print medium 212, and encompasses ink drops 250. During printing, ink drops 250 are ejected from printhead 232 toward print region 214 of print medium 212 to create print 216. As print medium 212 moves in the direction indicated by arrow 219, print 216 creates an already imprinted region 218 of print medium 212.

Air movement system 240 for inkjet printer 210 is similar to air movement system 40 for inkjet printer 10. Air movement system 240 directs an air stream 242 through print zone 215 as ink drops 250 are ejected from printhead 232 during printing. Air movement system 240 includes an airflow source 244, similar to airflow source 44, which creates a pressurized source of air which, in turn, generates and forces air stream 242 through print zone 215. In one embodiment, air movement system 240 also includes an airflow channel 246 which directs air stream 242 through print zone 215. Airflow channel 246 includes, for example, an inlet flow path 247 and outlet flow path 248. Inlet flow path 247 communicates with airflow source 244 which generates and forces air stream 242 through airflow channel 246.

In one embodiment, airflow source 244 includes an active or direct source which communicates with inlet flow path 247 to force air stream 242 through airflow channel 246. As such, outlet flow path 248 directs air stream 242 through print zone 215. An example of airflow source 244 includes a fan or blower positioned within inkjet printer 210 and communicated with airflow channel 246.

In one embodiment, air stream 242 is directed in a direction toward already-imprinted region 218 of print medium 212. As illustrated in FIG. 6, for example, print medium 212 moves in the direction indicated by arrow 219, from left to right, relative to print cartridge 230. Thus, already-imprinted region 218 is created to the right of printer carriage 220. Air stream 242, therefore, is directed in a direction from left to right toward already-imprinted region 218 or, conversely, opposite the printing direction indicated by arrow 219. Preferably, air stream 242 is directed through print zone 215 substantially parallel to front face 234 of print head 232 and substantially parallel to print region 214 of print medium 212 toward which ink drops 250 are ejected.

In one embodiment, one or more ink drops 250 include a head 252 and a tail 254 which separates from head 252 and forms a satellite 256 of ink drop 250. Head 252 and satellite 256 of ink drop 250 are similar to head 52 and satellite 56 of ink drop 50. Satellite 256, therefore, is smaller and has less volume than that of head 252 and has a different air resistance, speed, and trajectory than that of head 252. Thus, head 252 has a head trajectory 253 during printing and satellite 256 has a satellite trajectory 257 during printing.

Head trajectory 253 represents a path of head 252 of ink drop 250 during printing and satellite trajectory 257 represents a path of satellite 256 of ink drop 250 during printing. Since, at the time of ejection, tail 254 and, therefore, satellite 256 is a part of head 252, satellite trajectory 257 originates at a starting point of head trajectory 253. However, once tail 254 of ink drop 250 separates from head 252 and forms satellite 256 of ink drop 250, satellite trajectory 257 of satellite 256 diverges from head trajectory 253 of head 252 since satellite 256 is smaller than head 252 and has a different air resistance and speed than head 252.

Air movement system 240 directs air stream 242 through the intended ink drop trajectory of ink drops 250 during printing. More specifically, air stream 240 directs air stream 242 through head trajectory 253 of head 252 and satellite trajectory 257 of satellite 256 during printing. Since satellite 256 of ink drop 250 is smaller than head 252 of ink drop 250, satellite 256 is more greatly influenced by air stream 242 than is head 252. As such, air stream 242 of air movement system disrupts satellite trajectory 257 of satellite 256 during printing. Preferably, air stream 242, however, does not disrupt head trajectory 253 of head 252 during printing. As such, air stream 242 converges satellite trajectory 257 with head trajectory 253 during printing, as illustrated in FIG. 6.

Satellite trajectory 257 originates at a starting point of head trajectory 253, as described above, and terminates at approximately an ending point of head trajectory 253. Satellite trajectory 257, however, is longer than head trajectory 253. Thus, air movement system 240 and, more specifically, air stream 242 converges satellite 256, as a form of tail 254, and head 252 during printing in a manner similar to how air movement system 40 and, more specifically, air stream 42" converges satellite 56, as a form of tail 54, and head 52 during printing. It is understood that head trajectory 253 and satellite trajectory 257 of head 252 and satellite 256, respectively, as illustrated in FIG. 4, for example, have been exaggerated for clarity of the invention.

By directing air streams 42 (including air streams 42' and 42"), 142 (including air stream 142'), and 242 through print zones 15, 115, and 215, respectively, as ink drops 50, 150, 250 are ejected during printing, air movement systems 40, 140, and 240, respectively, converge tails 54, 154, and 254 and heads 52, 152, and 252, respectively, during printing. In addition, air movement systems 40 and 140 also converge satellites 56 and 256, as forms of tails 54 and 254, respectively, with heads 52 and 152, respectively, during printing. As such, extraneous printed features around the edges and/or in the background of a character, caused by tails 54, 154, and 254 or satellites 56 and 256, as forms of tails 54 and 254, respectively, of ink drops 50, 150, and 250, respectively, during printing, are avoided without compromising printing speed, printing reliability, and/or accommodation of various thickness of print medium.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An inkjet printer for printing on a print medium, the inkjet printer comprising:

a printhead having an ink orifice formed therein through which an ink drop is ejected into a print zone between the printhead and the print medium during printing; and an air movement system which directs a stream of gas through the print zone as the ink drop is ejected during printing, wherein the ink drop includes a head and a tail extending from the head, and wherein the stream of gas converges the tail of the ink drop and the head of the ink drop during printing.

2. The inkjet printer of claim 1, wherein the tail of the ink drop forms a satellite of the ink drop, and wherein the stream of gas converges the satellite of the ink drop with the head of the ink drop during printing.

3. The inkjet printer of claim 2, wherein the head of the ink drop has a head trajectory during printing and the satellite of the ink drop has a satellite trajectory during printing, and wherein the air movement system directs the stream of gas through the head trajectory and the satellite trajectory during printing.

4. The inkjet printer of claim 3, wherein the stream of gas disrupts the satellite trajectory during printing, but does not disrupt the head trajectory during printing.

5. The inkjet printer of claim 3, wherein the stream of gas converges the satellite trajectory with the head trajectory during printing.

6. The inkjet printer of claim 5, wherein the satellite trajectory originates at a starting point of the head trajectory and terminates at approximately an ending point of the head trajectory, and wherein the satellite trajectory is longer than the head trajectory.

7. The inkjet printer of claim 2, wherein the head of the ink drop forms a first dot on the print medium during printing and the satellite of the ink drop forms a second dot on the print medium during printing, and wherein the second dot is positioned within the first dot on the print medium.

8. The inkjet printer of claim 7, wherein the first dot has a first diameter and the second dot has a second diameter less than the first diameter.

9. The inkjet printer of claim 1, wherein the printhead moves in a first direction relative to the print medium during printing, and wherein the air movement system directs the stream of gas in a second direction opposite the first direction.

10. The inkjet printer of claim 1, wherein the print medium moves in a first direction relative to the printhead during printing, and wherein the air movement system directs the stream of gas in the first direction.

11. The inkjet printer of claim 1, wherein the air movement system directs the stream of gas in a direction toward an already-imprinted region of the print medium.

12. The inkjet printer of claim 1, wherein the stream of gas is an air stream.

13. The inkjet printer of claim 12, wherein the air movement system includes an airflow source which generates the air stream.

14. The inkjet printer of claim 12, wherein movement of the printhead within the printer generates the air stream.

15. The inkjet printer of claim 14, wherein the air movement system includes an air ram formed adjacent a leading end of the printhead, wherein the air ram directs the air stream from the leading end of the printhead to the print zone during printing.

16. The inkjet printer of claim 1, wherein the ink orifice is formed in a front face of the printhead, and wherein the air movement system directs the stream of gas substantially parallel to the front face of the printhead.

17. The inkjet printer of claim 1, wherein a speed of the stream of gas through the print zone is in a range of approximately 3 meters/second to approximately 10 meters/second.

18. The inkjet printer of claim 17, wherein the speed of the stream of gas through the print zone is in a range of approximately 3 meters/second to approximately 5 meters/second.

19. An inkjet printer for printing on a print medium, the inkjet printer comprising:

a printhead having an ink orifice formed therein through which an ink drop is ejected into a print zone between the printhead and the print medium during printing; and an air movement system which directs a stream of gas through the print zone as the ink drop is ejected during printing, wherein the ink drop includes a head and a tail, wherein the head of the ink drop has a first trajectory rate during printing and the tail of the ink drop has a second trajectory rate less than the first trajectory rate during printing, and wherein the stream of gas impedes the first trajectory rate of the head of the ink drop during printing.

20. The inkjet printer of claim 19, wherein the stream of gas converges the tail of the ink drop and the head of the ink drop during printing.

21. The inkjet printer of claim 19, wherein the printhead moves in a first direction relative to the print medium during printing, and wherein the air movement system directs the stream of gas in at least one of the first direction and a second direction opposite the first direction.

22. The inkjet printer of claim 19, wherein the air movement system directs the stream of gas in a direction toward an already-imprinted region of the print medium.

23. The inkjet printer of claim 19, wherein the stream of gas is an air stream.

24. The inkjet printer of claim 23, wherein the air movement system includes an airflow source which generates the air stream.

25. The inkjet printer of claim 23, wherein movement of the printhead within the printer generates the air stream.

26. The inkjet printer of claim 19, wherein the ink orifice is formed in a front face of the printhead, and wherein the air movement system directs the stream of gas substantially parallel to the front face of the printhead.

27. The inkjet printer of claim 19, wherein a speed of the stream of gas through the print zone is in a range of approximately 3 meters/second to approximately 10 meters/second.

28. A method of printing on a print medium with an inkjet printer including a printhead having an ink orifice formed therein, the method comprising the steps of:

ejecting an ink drop through the ink orifice toward the print medium into a print zone between the printhead and the print medium during printing, including forming a head and a tail of the ink drop, wherein the head of the ink drop has a first trajectory rate during printing and the tail of the ink drop has a second trajectory rate less than the first trajectory rate during printing; and directing a stream of gas through the print zone as the ink drop is ejected during printing, wherein the stream of gas impedes the first trajectory rate of the head of the ink drop during printing.

29. The method of claim 28, wherein the stream of gas converges the tail of the ink drop and the head of the ink drop during printing.

30. The method of claim 28, further comprising the step of:

moving the printhead in a first direction relative to the print medium during printing, wherein the step of directing the stream of gas through the print zone includes directing the stream of gas in at least one of the first direction and a second direction opposite the first direction.

31. The method of claim 28, wherein the step of directing the stream of gas through the print zone includes directing the stream of gas in a direction toward an already-imprinted region of the print medium.

32. The method of claim 28, wherein the step of directing the stream of gas through the print zone includes directing an air stream through the print zone during printing.

33. The method of claim 32, wherein directing the air stream through the print zone includes generating the air stream with an airflow source.

34. The method of claim 32, wherein directing the air stream through the print zone includes generating the air stream by movement of the printhead within the printer.

35. The method of claim 28, wherein the ink orifice is formed in a front face of the printhead, and wherein the step of directing the stream of gas through the print zone includes directing the steam of gas substantially parallel to the front face of the printhead.

36. The method of claim 28, wherein the step of directing the stream of gas through the print zone includes directing the stream of gas with a speed in a range of approximately 3 meters/second to approximately 10 meters/second.

37. A method of printing on a print medium with an inkjet printer including a printhead having an ink orifice formed therein, the method comprising the steps of:

ejecting an ink drop through the ink orifice toward the print medium into a print zone between the printhead and the print medium during printing, including forming a head of the ink drop and a tail of the ink drop extending from the head; and directing a stream of gas through the print zone as the ink drop is ejected during printing, wherein the stream of gas converges the tail of the ink drop and the head of the ink drop during printing.

38. The method of claim 37, wherein forming the he ad and the tail of the ink drop further includes forming a satellite of the ink drop from the tail of the ink drop, and wherein the stream of gas converges the satellite of the ink drop with the head of the ink drop during printing.

39. The method of claim 38, wherein the head of the ink drop has a head trajectory during printing and the satellite of the ink drop has a satellite trajectory during printing, and wherein the step of directing the stream of gas through the print zone includes directing the stream of gas through the head trajectory and the satellite trajectory during printing.

40. The method of claim 39, wherein the stream of gas disrupts the satellite trajectory during printing but does not disrupt the head trajectory during printing.

41. The method of claim 39, wherein the stream of gas converges the satellite trajectory with the head trajectory during printing.

42. The method of claim 41, wherein the satellite trajectory originates at a starting point of the head trajectory and terminates at approximately an ending point of the head trajectory, and wherein the satellite trajectory is longer than the head trajectory.

43. The method of claim 38, further comprising the step of:

forming a first dot on the print medium with the head of the ink drop during printing and forming a second dot on the print medium with the satellite of the ink drop during printing, wherein forming the second dot on the print medium includes positioning the second dot within the first dot on the print medium.

44. The method of claim 43, wherein the first dot has a first diameter and the second dot has a second diameter less than the first diameter.

45. The method of claim 37, further comprising the step of:

moving the printhead in a first direction relative to the print medium during printing, wherein the step of directing the stream of gas through the print zone includes directing the stream of gas in a second direction opposite the first direction.

46. The method of claim 37, further comprising the step of:

moving the print medium in a first direction relative to the printhead during printing, wherein the step of directing the stream of gas through the print zone includes directing the stream of gas in the first direction.

47. The method of claim 37, wherein the step of directing the stream of gas through the print zone includes directing the stream of gas in a direction toward an already-imprinted region of the print medium.

48. The method of claim 37, wherein the step of directing the stream of gas through the print zone includes directing an air stream through the print zone during printing.

49. The method of claim 48, wherein directing the air stream through the print zone includes generating the air stream with an airflow source.

50. The method of claim 48, wherein directing the air stream through the print zone includes generating the air stream by movement of the printhead within the printer.

51. The method of claim 50, wherein generating the air stream by movement of the printhead includes directing the air stream from a leading end of the printhead to the print zone during printing with an air ram formed adjacent the leading end of the printhead.

52. The method of claim 37, wherein the ink orifice is formed in a front face of the printhead, and wherein the step of directing the stream of gas through the print zone includes directing the steam of gas substantially parallel to the front face of the printhead.

53. The method of claim 37, wherein the step of directing the stream of gas through the print zone includes directing the stream of gas with a speed in a range of approximately 3 meters/second to approximately 10 meters/second.

54. The method of claim 37, wherein the step of directing the stream of gas through the print zone includes directing the stream of gas with a speed in a range of approximately 3 meters/second to approximately 5 meters/second.

* * * * *

UNITED STATES PATENT AND TRADEMARK OFFICE

CERTIFICATE OF CORRECTION

PATENT NO. : 6,491,364 B1
DATED : December 10, 2002
INVENTOR(S) : Pietrzyk (deceased) et al.

It is certified that error appears in the above-identified patent and that said Letters Patent is hereby corrected as shown below:

Column 6,
Line 36, delete “portion-of” and insert therefor -- portion of --.

Column 14,
Line 28, delete “he ad” and insert therefor -- head --.

Signed and Sealed this

Second Day of March, 2004

JON W. DUDAS
*Acting Director of the United States Patent and Trademark Office*